United States Patent [19]

Ahr

[11] 4,262,599

[45] Apr. 21, 1981

[54] CONVEYOR SYSTEM WITH A MAINTENANCE STATION

[75] Inventor: Dieter Ahr, Berlin, Fed. Rep. of Germany

[73] Assignee: Siemens Aktiengesellschaft, Berlin & Munich, Fed. Rep. of Germany

[21] Appl. No.: 943,191

[22] Filed: Sep. 18, 1978

[30] Foreign Application Priority Data

Sep. 28, 1977 [DE] Fed. Rep. of Germany ..... 2744072

[51] Int. Cl.[3] ..... B61J 3/00

[52] U.S. Cl. ..... 104/88; 198/350

[58] Field of Search ..... 104/88; 414/136; 198/350–355

[56] References Cited

U.S. PATENT DOCUMENTS

| | | | |
|---|---|---|---|
| 3,075,653 | 1/1963 | Wales et al. | 198/350 |
| 3,168,053 | 2/1965 | Miroux | 198/350 |
| 3,340,821 | 9/1967 | Wesener | 104/88 |
| 3,643,784 | 2/1972 | Kretzschmar et al. | 198/353 |
| 3,812,786 | 5/1974 | Cahn | 104/88 |
| 4,056,063 | 11/1977 | Ritter | 104/88 |

FOREIGN PATENT DOCUMENTS

| | | | |
|---|---|---|---|
| 1811650 | 6/1970 | Fed. Rep. of Germany | 198/350 |
| 2005591 | 6/1974 | Fed. Rep. of Germany | 198/353 |

*Primary Examiner*—John J. Love
*Assistant Examiner*—Ross Weaver
*Attorney, Agent, or Firm*—Hill, Van Santen, Steadman, Chiara & Simpson

[57] ABSTRACT

In an illustrative embodiment, a scanning and control device which conventionally scans a destination field on each conveyor receptacle is provided with a selectively settable maintenance scanning arrangement for scanning a maintenance field on the conveyor receptacles, and for sending receptacles having the currently selected maintenance characteristic for maintenance processing. Where maintenance occupies a small proportion of total operating time, each receptacle may selectively receive one of two maintenance characteristics with a shift therebetween being made after each servicing. With a relatively greater maintenance time, phases of maintenance are established with subsets of the total number of receptacles being assigned different pairs of maintenance characteristic values which can be differentiated by the scanning and control device, and which may be sequentially selected thereby.

8 Claims, 7 Drawing Figures

CONVEYOR SYSTEM WITH A MAINTENANCE STATION

BACKGROUND OF THE INVENTION

The invention relates to a conveyor system having a route network of profile rails, on which conveyor carts travel with drive devices, fed via current paths of the profile rails, and having at least one maintenance station interposed in the route network.

The conveyor carts traveling in such conveyor systems exhibit some components which must be examined regularly, although at greater intervals. This involves electrical as well as mechanical components such as, for example, gear units, or brushes used for conveying electric energy to the motors. Since the maintenance proceeds during the operation of the conveyor system and since a large number of the conveyor receptacles must remain in the conveyor system in order to handle the accumulating transport requirements, serviced conveyor carts must be immediately fed back into the conveyor system. With a subsequent delivery of conveyor carts, not yet serviced, to the maintenance station the problem occurs of how to differentiate serviced conveyor carts from the ones not yet serviced and to guarantee that all conveyor receptacles are included in the maintenance phase. This problem could certainly be solved with the aid of operating personnel and with the aid of lists oriented, for example, to various receptacle members.

SUMMARY OF THE INVENTION

The invention has the underlying objective to dispense with the help of operating personnel for the determination of all conveyor carts to be serviced and to realize the simplest possible differentiation constructively as well as functionally between serviced and not yet serviced conveyor carts. This is inventively obtained in that a scanning and control device is arranged at a location of the route network frequently passed by conveyor carts, the scanning and control device being adjusted at the beginning of a maintenance period such that the conveyor carts, passing the scanning and control device, are rerouted to the maintenance station with the aid of a characteristic value of a scannable maintenance characteristic adjusted to characterize a specific preceeding maintenance period, and that after every servicing the characteristic value of the maintenance characteristic is altered according to a maintenance period characteristic.

At the beginning of a maintenance period, conveyor carts with a specific characteristic value of the maintenance characteristic are rerouted to the maintenance station. The scanning and control device is adjusted or controlled such that in specific time intervals only a limited number of conveyor carts passing the scanning and control device are rerouted so that the number of conveyor carts simultaneously taken out of the conveyor system, does not become too great. The already serviced conveyor carts fed back into the route network are differentiated from the conveyor carts not yet serviced by means of altering the characteristic value of the scannable maintenance characteristic attached to said already serviced carts, and are accordingly not again rerouted to the maintenance station. At the beginning of a new maintenance period, all conveyor carts of the route network accordingly exhibit a characteristic value of the scannable maintenance characteristic which characterizes the preceeding maintenance period. The scanning and control device is now adjusted or re-adjusted such that it reroutes conveyor carts to the maintenance station which have this characteristic value of the maintenance characteristic, and the maintenance characteristic is again altered after the maintenance operation is completed. Subsequently the same conditions as in the first maintenance phase are again present with the third maintenance period.

A particular advantage of the inventive conveyor system is thereby to be seen in the simple adjustment to the respectively changing conditions in the consecutive maintenance periods by means of a simple conversion of the criterion obtained from the scanning of the maintenance characteristic.

The scanning and control device is arranged at a location of the route network selected under the aspect that all conveyor carts of the route network should pass this location in the shortest time possible. Accordingly, the location where the scanning and control device is established will lie at varying locations in accordance with varying route network designs. A possible location, for example, is a central connection line between several partial lines of the route network; a vertical connection route, for example, is to be considered as such a central connection line, where the vertical connection route connects several primarily horizontal conveyor lines on respective floors of a multi-story building since each of the conveyor carts conveyed from one floor to another must take the route via the vertical connection line.

However, conveyor systems are also possible either highly dispersed, or in which specific conveyor receptacles always communicate only between very specific locations of the route network so that no location in the route network can be determined offering safe assurance that all conveyor receptacles pass this location within a reasonably short period. In such a case, the scanning and control device can also be arranged at two or more correspondingly selected locations of the conveyor system.

Where a collector store is provided in the conveyor system for presently not used non-loaded conveyor carts, said collector store is preferably to be used as the location for the scanning and control device. The mounting of the scanning and control device at this location simultaneously offers the advantage that generally non-loaded conveyor carts arrive at the maintenance station and the goods to be transported must there be reloaded into already serviced conveyor carts and must be conveyed to the original destination with a corresponding adjustment of the destination setting device. Where several such collector stores are arranged in the conveyor system, a scanning and control device is expediently provided in the vicinity of several, preferably all of the collector stores.

When the scanning of a maintenance characteristic with the aid of the scanning and control device makes the rerouting of the conveyor cart to the maintenance station necessary, this rerouting need not proceed immediately. The rerouting, for example, can also proceed such that the conveyor cart is directed to a different receiver station, generally continuously occupied, and is there subjected to a previous visual control. This visual control can particularly relate to an operating hour counter which indicates how long the conveyor cart has traveled in the route network since the last servicing. The conveyor cart is only then rerouted to the maintenance station when a predetermined operating time of the conveyor cart is present. Such an intermediate circuit of a station can particularly then be provided when this station has a more central location than the maintenance station, as thereby the time during which the conveyor carts are unnecessarily taken out of the route network, can be shortened.

The number of the adjustable characteristic values of the maintenance characteristic depends upon the length of the maintenance period with consideration for an empirically determined maximum operating time of the conveyor carts. Where the maintenance period, for example, due to the great number of the conveyor carts to be serviced and/or due to the few daily maintenance hours in relation to the actual operating time of the conveyor system, is relatively long for the case of only two characteristic values of the maintenance characteristic conveyor carts, which were serviced at the end of the preceeding maintenance period, and which are rerouted to the maintenance station at the beginning of the subsequent maintenance period, would again be serviced in an unnecessarily short interval.

In order to prevent an unnecessarily rapid repetition of two servicings on the same conveyor cart it would be advantageous if each maintenance period including all conveyor carts comprised several successive maintenance phases, and that the characteristic values of the maintenance characteristic and the scanning and control device are adjusted such that in each maintenance phase the conveyor carts serviced in the same maintenance phase of the preceding maintenance interval, are rerouted to the maintenance station. By providing four different characteristic values, for example, two different characteristic values can be set within one maintenance period so that in the subsequent maintenance period the conveyor carts, serviced first during the first maintenance phase of the preceding maintenance period, are conveyed to the maintenance station; however, the conveyor carts, serviced in the second maintenance phase of the preceding maintenance period, are only conveyed to the maintenance station at the beginning of the second maintenance phase of the current maintenance period. Thereby a greater evening-out of the chronological intervals between two servicings of each individual conveyor cart, communicating in the conveyor system, can be obtained, and the operating period between two maintenance periods in particular can be increased.

If the maintenance period vis-a-vis the operating period is very short, a delimitation to only two characteristic values of the maintenance characteristic can advantageously be provided since the interval between two servicings of each conveyor receptacle differs relatively little in relation to the chronological mean value of the maintenance intervals of each conveyor cart provided by the mean interval of the two maintenance periods.

A great number of different realization possibilities exist for the maintenance characteristic. A design of the maintenance characteristic, identical with the design of characteristic elements of a destination adjustment device of the conveyor carts, is considered advantageous, as then the maintenance scanning and control device or the scanning elements thereof, together with the scanning elements of a destination evaluation device related to the destination control device, can be arranged on a joint carrier and advantageous constructive embodiments can thereby be obtained.

If for example metal plates, displacable on a strip, represent the scanning elements of the destination adjustment device, of the conveyor carts, which are evaluated by proximate scanner elements of the destination evaluation device, the maintenance characteristic can also be designed, as a metal plate which, however, is to be fixedly secured in a correspondingly designed receptacle outside of the operative field of the destination adjustment device.

The simplest means of attaching the scannable maintenance characteristic results by providing an adhesive foil on each maintenance characteristic, whereby the maintenance characteristic can be attached to the conveyor cart at an arbitrary location.

In a further development of this mounting possibility it is provided that the maintenance characteristic per se is formed by an adhesive foil; and adhesive foil can thereby be metallically or magnetically coated or with its surface can represent an optically evaluatable characteristic.

The invention is subsequently explained with the aid of the accompanying sheets of drawings; and other objects, features and advantages will be apparent from this detailed disclosure.

DETAILED DESCRIPTION

Figure 1:
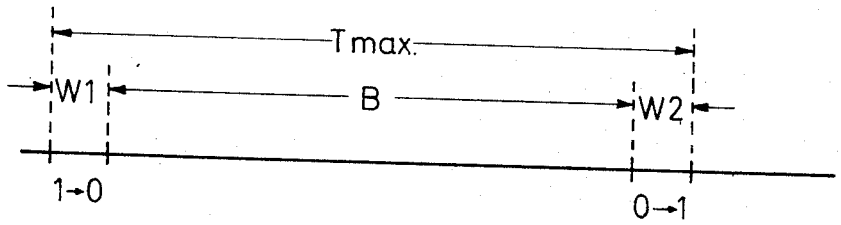
FIGS. 1, 2 and 3 are diagrammatic illustrations useful in explaining the present invention.

FIG. 1 relates to a conveyor system in which the maintenance period W1, W2 is relatively short vis-a-vis the operating period B. The maintenance periods W1, W2 must be allocated such that the sum of two maintenance periods W1, W2 and of an operating period B corresponds with the maximum time length Tmax between two consecutive servicings of one and the same conveyor receptacle. This correlation results from the fact that the conveyor cart serviced first in the maintenance period W1 could perhaps be serviced as the last of all conveyor carts in the maintenance period W2. In the present example the arrangement would be such that all conveyor carts bear the characteristic value "1" before the maintenance period W1, and that said characteristic value "1" is altered into the characteristic value "0" during the maintenance period W1, the characteristic value "0" being present during the total operating period B. The characteristic value "0" is altered into characteristic value "1" in the maintenance period W2.

Figure 2:
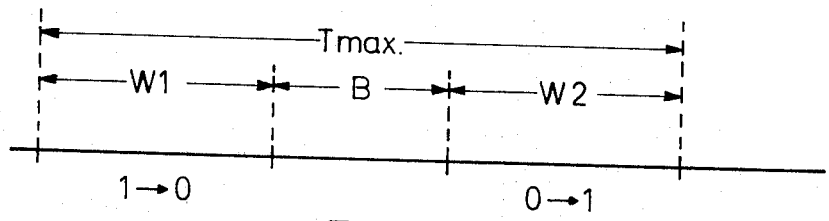

FIG. 2 illustrates the operating conditions in a conveyor system, in which the maintenance periods W1 and W2 are relatively long. In order to meet the requirement here also that the sum of two maintenance periods W1, W2 and of an operating period B may at most be equal to the maximum period Tmax between two consecutive servicings of the same conveyor cart, the operating period B, resulting therefrom, is shorter than each of the two maintenance periods W1 and W2. The characteristic values of the maintenance characteristic are identical with the ones of the example illustrated in FIG. 1 in the two maintenance periods W1 and W2 and in the operating period B.

Figure 3:
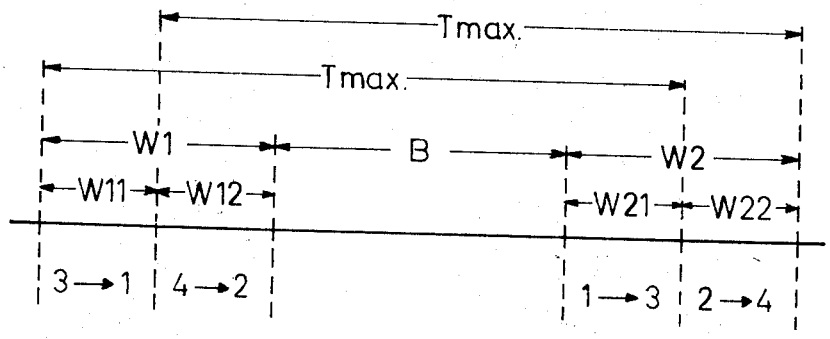

FIG. 3 illustrates the operating conditions resulting when the maintenance periods W1, W2 of FIG. 2 are respectively subdivided into two maintenance phases W11, W12; W21, W22. It is thereby assumed that the conveyor carts bear the characteristic values "3" and "4" before the maintenance period W1. In the first maintenance phase W11 of the maintenance period W1, only those conveyor carts are rerouted to the maintenance station which bear the characteristic value of "3", whereby this characteristic value is altered into the characteristic value of "1" after the servicing. In the second maintenance phase of W12, only those conveyor carts with the characteristic value of "4" are rerouted to the maintenance station, whereby the characteristic value of "4" is altered into "2" after the servicing. Thus, conveyor carts with the characteristic value of "1" or "2" are located in the conveyor system in the subsequent operating period of B. In the subsequent maintenance period W2, only those conveyor carts with the characteristic value of "1" are firstly rerouted to the maintenance station and are there provided with the characteristic value of "3" after the servicing is completed; during the second maintenance phase of W2, the maintenance of the conveyor carts with the characteristic value of "2" and the alteration of the characteristic value of "2" into "4" results accordingly, whereby again the same operating conditions in the system exist as before the maintenance period of W1.

As can be concluded from a comparison of FIGS. 2 and 3, in spite of adhering to the maximum period Tmax between two successive maintenance operations on the same conveyor cart, the operating period B between two maintenance periods W1, W2 have become longer, i.e. the servicing can take place at greater intervals than in the conveyor system in accordance with FIG. 2.

Figure 4:
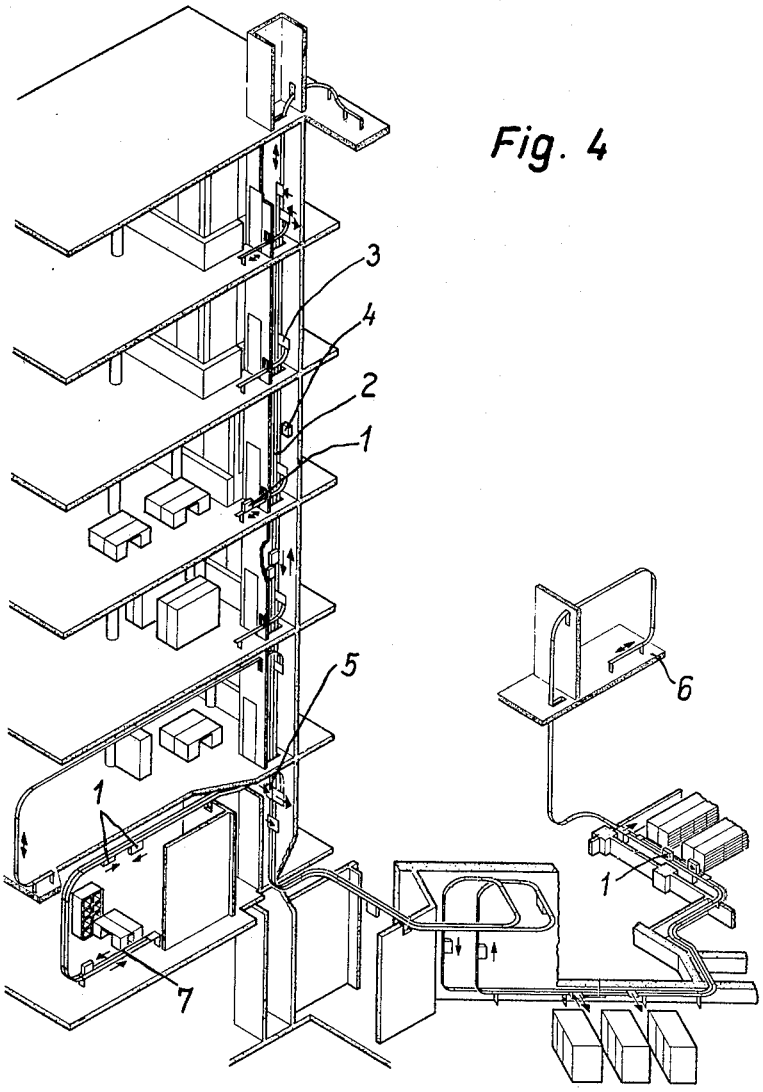
FIG. 4 is a diagrammatic perspective view showing a completely installed conveyor system including a scanning and control device operable in accordance wth the present invention.

FIG. 4 shows a completely installed conveyor system in which the conveyor carts 1 can travel on the profile rails 2 via controllable shunts 3 in a horizontal and also in a vertical direction. The conveyor carts 1 are thereby driven by their own electric motors which receive their energy via current rails arranged within the profile rails 3. The feed of the current rails proceeds via the network apparatus 4 which can simultaneously take over the voltage supply for additional control processes within the conveyor system, for example, the control of the shunts 3.

The scanning and control device 5 is provided at a central point within the conveyor system, the device serving to automatically direct the conveyor carts 1, not yet serviced, to the maintenance station 6 within one maintenance period. It is also plausible that the scanning and control device 5 firstly directs the conveyor carts 1 to the receiver point 7, where an operator reads the operating hour counter, mounted on the conveyor carts 1, in order to initiate, if necessary, the conveyance to the maintenance station 6.

Figure 5:
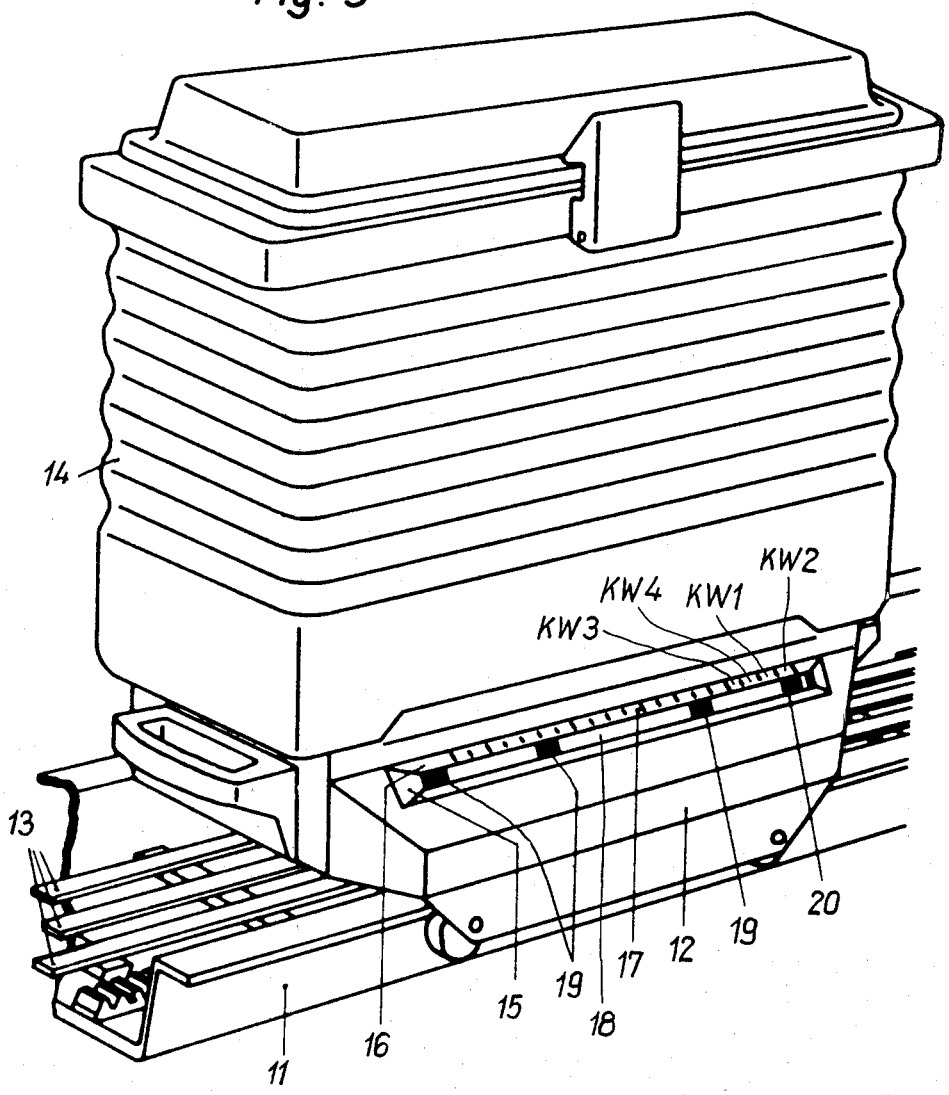
FIG. 5 is a perspective view of a conveyor cart arranged on a profile rail, and having a scannable maintenance field with an adjustable maintenance characteristic.

FIG. 5 shows a conveyor cart conveyed on a profile rail, in perspective illustration. The conveyor cart essentially consists of the chassis 12 (including the drive device), which runs on rollers on the profile rail 11 and is driven and controlled via the current rails 13, and also consists of the carrier 14 for goods to be transported, which can be closed in the upper area. The chassis 12 exhibits an inclined carrier surface supporting the target setting rail 15. The target setting rail 15 contains not only the destination setting field 16 having marks 17 indicating the possible destination setting positions, but also the characteristic selection field 18 having displacable metal plates 19, 20.

The displacable metal plates 19 in this embodiment of the conveyor cart are provided for the setting of the desired destination, whereas the displacable metal plate 20 serves as maintenance characteristic, and in the position of the characteristic value KW1 represents, for example, a first maintenance period, and in the position of the characteristic value KW2 represents an additional maintenance period.

As not only the setting field 16, but also the characteristic field 18 is visible and can be reached from above, an operator standing at the side of the conveyor cart not facing the target setting rail 15, can undertake every necessary target setting without problem, by reaching over the conveyor cart.

Figure 6:
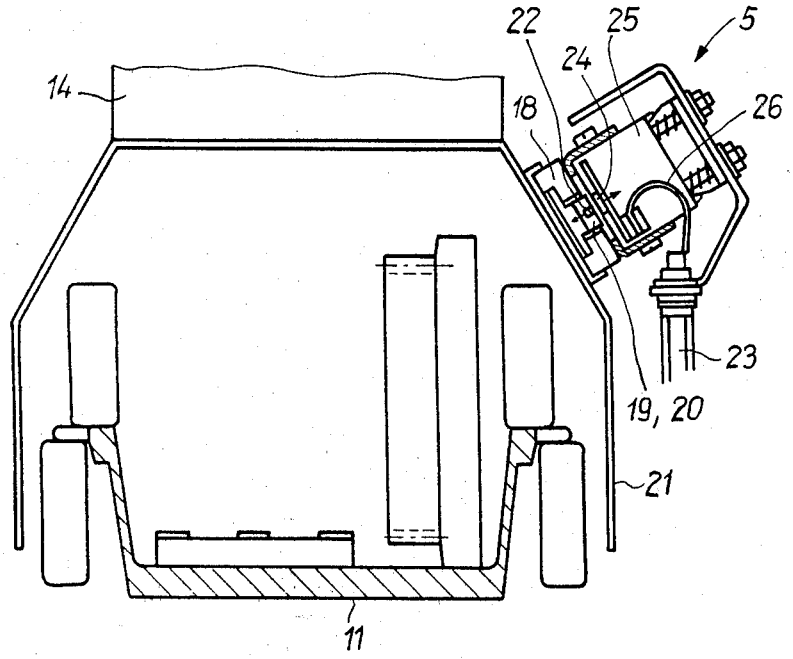
FIG. 6 is a diagrammatic cross sectional view showing the conveyor cart with its maintenance field, and illustrating the scanning thereof.

The essential components of a conveyor cart traveling on the profile rail 11, with characteristic field 18 and also the scanning and control device mounted on a carrier 23, can be concluded from FIG. 6 in schematic illustration. In the upper range of the chassis housing 21, the actual conveyor container 14 is attached which—not illustrated—can be separated from the chassis housing 21.

The characteristic field 18 is arranged on a side surface of the chassis housing 21 inclined vis-a-vis the vertical. The characteristic field 18 has metal plates 19, 20, consisting of nonmagnetic material, with permanent magnets 22 embedded in said metal plates. The polarization of the permanent magnets 22 is symbolized by arrows.

Scanning devices are arranged at selected locations alongside of the profile rails 11, one of these scanning devices being schematically illustrated in FIG. 6. The scanning device is arranged on a carrier 23 such that magnetic field operable non-contacting switches 24, arranged in a scanning device support 25, are directly opposite the permanent magnets 22. The connection of the non-contacting switches 24 with electric evaluation devices adjusted thereto, proceeds via a multi-poled flat band cable 26.

Figure 7:
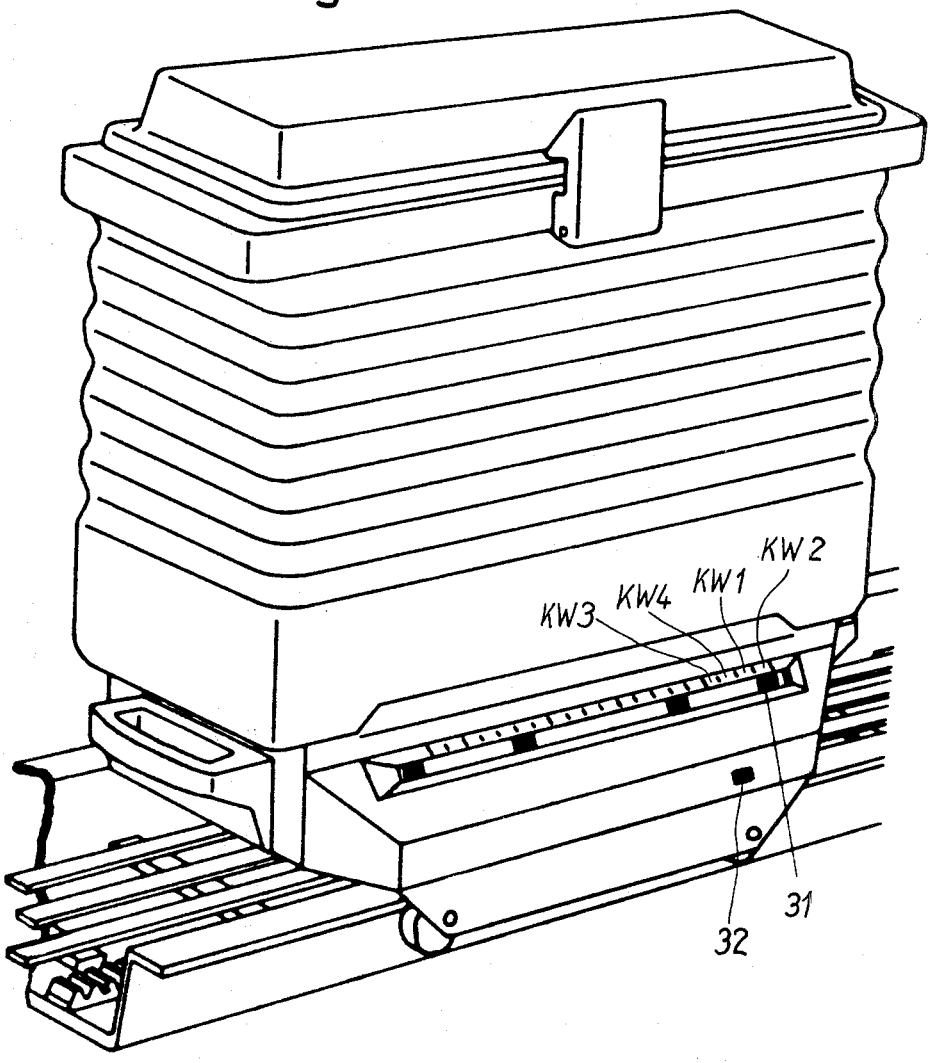
FIG. 7 is a perspective view of a conveyor cart with a different maintenance characteristic means.

FIG. 7 illustrates a conveyor cart in which the maintenance characteristic instead of being a displacable metal plate 20 as in FIG. 5, is provided by adhesive foil, the adhesive foil 31 being attached within the characteristic field, and the adhesive foil 32 being attached at a suitable different point, for example, to the chassis housing. With reflecting adhesive foils it would be imaginable to undertake the scanning of the maintenance characteristic optically, so that the adhesive foils can simultaneously form the maintenance characteristics.

In an embodiment corresponding to FIG. 3, the maintenance characteristic means 20 of FIG. 5 may be shifted from position KW2 to position KW4 after servicing in a phase corresponding to W22 of FIG. 3. Then at the beginning of a subsequent phase corresponding to W12 of FIG. 3, the scanning and control device 5 is set to respond to a permanent magnet such as 22, FIG. 6, in such position KW4. (In a phase corresponding to W11 of FIG. 3, the scanning and control device 5 only responds to conveyor carts with a permanent magnet, such as 22, at position KW3, FIG. 5.) By way of example, a set of four logical AND circuits may each have one input connected to one of four magnetic field responsive switches 24, FIG. 6, second inputs of the AND circuits being respectively enabled to define the respective phases of FIG. 3, and third inputs of all of the AND circuits being activated each time a conveyor cart moves into the correct position for scanning of its field 18 (e.g. in response to a magnet at a location such as indicated at 32, FIG. 7, on each cart of the system.) The set of conveyor carts to be serviced during a phase such as W21 in FIG. 3 would have maintenance characteristic means 20 at a position corresponding to KW1 prior to such phase, and at a position corresponding to KW3 at the end of such phase, for example. For the case of maintenance characteristic means 31, 32, FIG. 7, the set of conveyor carts to be serviced during phase W22 might have reflective adhesive foil 31 shifted to the position KW4 after servicing in phase W22, to represent state "4" of FIG. 3. On the other hand, the set of carts to be serviced in phase W21, might have reflective adhesive foil such as 31 initially at KWL, FIG. 7, the foil corresponding to foil 31 being shifted between positions such as KW1 and KW3 to shift from state "1" to state "3" of FIG. 3. In each case, all conveyor carts would be identical except for the location of the selection elements such as 19, 20, or 31.

It will be apparent that many modifications and variations may be effected without departing from the scope of the novel concepts and teachings of the present invention.

I claim as my invention:

1. A conveyor system comprising a route network of profile rails with branching locations, conveyor carts for travel on the rails and having drive devices which are fed via current paths of the profile rails, adjustable route selection characterizing elements fastened to the conveyor carts for controlling the path of the conveyor carts over the route network, route selection scanning and control devices selectively responsive to said route selection characterizing elements and associated with the branching locations of the route network, and at least one maintenance station for servicing of the conveyor carts and interposed in the route network, wherein the improvement comprises a maintenance scanning and control device which is arranged at a location of the route network which is passed frequently by conveyor carts, said conveyor carts having maintenance status characterizing means selectively adjustable for selectively providing first and second scannable maintenance characteristic values corresponding to first and second maintenance phases, said maintenance scanning and control device being selectively adjustable to respond to said first and second maintenance characteristic values but not to respond to either thereof prior to the beginning of a respective corresponding maintenance phase and being operable in one current maintenance phase to respond only to said first maintenance characteristic value set after a specific preceding maintenance phase to reroute the associated conveyor cart to the maintenance station, and means at the maintenance station whereby each such rerouted conveyor cart after maintenance in said maintenance station during such current maintenance phase has its maintenance status characterizing means permanently adjusted to said second maintenance characteristic value until such conveyor cart is again selected for maintenance.

2. A conveyor system according to claim 1, characterized in that the maintenance scanning and control device is arranged in the vicinity of a collector store for presently not used nonloaded conveyor carts.

3. A conveyor system according to claim 1, characterized in that each maintenance period (W1, W2) including all conveyor carts, comprises several consecutive maintenance phases (W11, W12; W21, W22), and that the maintenance scanning and control device is adjustable to respond to respective maintenance characteristic values corresponding to the respective maintenance phases such that in each maintenance phase (W21, W22) the conveyor carts, serviced in the same preceding maintenance phase (W11, W12) of the preceding maintenance period (W1), are rerouted to the maintenance station.

4. A conveyor system according to claim 1, characterized in that said maintenance status characterizing means (20; 31) can selectively be attached to or removed from respective value representing regions of the conveyor cart to represent respective maintenance characteristic values.

5. A conveyor system according to claim 4, characterized in that the maintenance status characterizing means (20) exhibits the same design as the characteristic elements (19) of a destination adjustment device (15) of the conveyor carts.

6. A conveyor system according to claim 5, characterized in that the maintenance scanning and control device exhibits scanning elements (24) which, together with the scanning elements of a destination evaluation device, relating to the destination adjustment device (15), are arranged on a joint carrier (25).

7. A conveyor system according to claim 4, characterized in that the maintenance status characterizing means (31, 32) is attached to the conveyor cart with the aid of an adhesive foil.

8. A conveyor system according to claim 7, characterized in that each of the maintenance status characterizing means (31, 32) consists of an adhesive foil.

* * * * *